US012090541B2

(12) United States Patent
Fujii et al.

(10) Patent No.: US 12,090,541 B2
(45) Date of Patent: Sep. 17, 2024

(54) PRESS FORMING METHOD AND SHAPE EVALUATION METHOD FOR PRESS FORMED PART

(71) Applicant: JFE STEEL CORPORATION, Tokyo (JP)

(72) Inventors: Yusuke Fujii, Tokyo (JP); Masaki Urabe, Tokyo (JP); Shunsuke Tobita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 242 days.

(21) Appl. No.: 17/799,782

(22) PCT Filed: Oct. 2, 2020

(86) PCT No.: PCT/JP2020/037619
§ 371 (c)(1),
(2) Date: Aug. 15, 2022

(87) PCT Pub. No.: WO2021/171678
PCT Pub. Date: Sep. 2, 2021

(65) Prior Publication Data

US 2023/0100401 A1 Mar. 30, 2023

(30) Foreign Application Priority Data

Feb. 25, 2020 (JP) ..... 2020-029205

(51) Int. Cl.
*B21D 22/26* (2006.01)

(52) U.S. Cl.
CPC ..... *B21D 22/26* (2013.01)

(58) Field of Classification Search
CPC ..... B21D 22/02; B21D 22/10; B21D 22/20; B21D 22/22; B21D 22/26; B21D 24/005
See application file for complete search history.

(56) References Cited

U.S. PATENT DOCUMENTS

2013/0134737 A1 5/2013 Ogata et al.
2015/0039247 A1 2/2015 Minote et al.
(Continued)

FOREIGN PATENT DOCUMENTS

JP H04-9225 A 1/1992
JP 2006-212663 A 8/2006
(Continued)

OTHER PUBLICATIONS

Jul. 7, 2023 Extended European Search Report issued in European Patent Application No. 20921529.2.
(Continued)

*Primary Examiner* — Teresa M Ekiert
(74) *Attorney, Agent, or Firm* — Oliff PLC

(57) ABSTRACT

A press forming method for controlling a shape change of a press formed part over time after the press formed part springs back at a moment of a release from a press-forming die includes: a press forming step of press forming a metal sheet into the press formed part by using the press-forming die; a die releasing step of releasing the press formed part, which is press-formed, from the press-forming die; and a post-release die holding step of holding the released press formed part in a forming bottom dead center shape for 30 minutes or more by using the press-forming die.

2 Claims, 13 Drawing Sheets

(56) References Cited

U.S. PATENT DOCUMENTS

| | | | | |
|---|---|---|---|---|
| 2015/0064052 | A1 | 3/2015 | Tokita et al. | |
| 2016/0375477 | A1* | 12/2016 | Tanaka | B21D 22/26 72/356 |
| 2018/0285488 | A1* | 10/2018 | Zhu | G06F 30/20 |

FOREIGN PATENT DOCUMENTS

| | | | |
|---|---|---|---|
| JP | 2007-308744 | A | 11/2007 |
| JP | 2013-113144 | A | 6/2013 |
| JP | 2013-198927 | A | 10/2013 |
| JP | 5795151 | B2 | 10/2015 |
| JP | 5866892 | B2 | 2/2016 |
| JP | 6197766 | B2 | 9/2017 |
| KR | 2003-0001012 | A | 1/2003 |

OTHER PUBLICATIONS

Dec. 8, 2020 International Search Report issued in International Patent Application No. PCT/JP2020/037619.

Abed, Aseel Hamad, "The Effect of Hold Time on the Spring Back Phenomenon in a V-Dies Bending Process," Eng. & Tech. Journal, vol. 30, No. 19, pp. 3384-3393, 2012.

Hama, Takayuki et al., "Time-dependent springback of a commercially pure titanium sheet," Procedia Engineering 207, pp. 263-268, 2017.

Lim, H. et al., "Time-dependent Spingback," International Journal of Material Forming, pp. 157-160, 2008.

* cited by examiner (a) PERSPECTIVE VIEW (b) TOP VIEW

PRESS FORMING METHOD AND SHAPE EVALUATION METHOD FOR PRESS FORMED PART

FIELD

The present invention relates to a press forming method and a shape evaluation method for a press formed part, and specifically relates to a press forming method and a shape evaluation method for a press formed part, with which methods a shape change of a press formed part over time from immediately after a release from a press-forming die and springback is controlled, and a measure against the shape change of the press formed part, which is used in a next step, over time is taken.

BACKGROUND

Press forming is a manufacturing method capable of manufacturing metal parts at a low cost in a short time, and is used for manufacturing of many automotive parts. In recent years, in order to achieve both improvement in collision safety of an automobile and weight reduction of an automotive body, a metal sheet having higher strength is used for press forming of the automotive parts.

One of main problems of a case where a high-strength metal sheet is press-formed is deterioration in dimensional accuracy of a press formed part due to springback. A phenomenon in which a residual stress generated in the press formed part when the metal sheet is deformed with a press-forming die by the press forming becomes a driving force and the press formed part released from the press-forming die instantaneously tries to return to a shape of the metal sheet before the press forming like a spring is called springback.

Since the residual stress of the press formed part which stress is generated by the press forming becomes large with respect to a metal sheet having high strength (such as high-tensile steel sheet), a shape change of the press formed part due to the springback also becomes large. Thus, it becomes difficult to keep the shape of the press formed part after the springback within a prescribed dimension as the metal sheet has higher strength. Thus, a technique of accurately predicting the shape change of the press formed part due to the springback is important.

A press forming simulation by a finite element method is generally used to predict the shape change of the press formed part due to the springback. A procedure in the press forming simulation is divided into a first stage in which a press forming analysis of a process of press forming a metal sheet up to a forming bottom dead center with a press-forming die is performed first and a residual stress generated in a press formed part is predicted (for example, Patent Literature 1), and a second stage in which a springback analysis in which a shape of press formed part removed from a press-forming die is changed due to springback is performed and a shape of the press formed part with which shape a moment of force and a residual stress are balanced is predicted (for example, Patent Literature 2).

CITATION LIST

Patent Literature

Patent Literature 1: Japanese Patent No. 5795151
Patent Literature 2: Japanese Patent No. 5866892
Patent Literature 3: Japanese Patent Application Laid-open No. 2013-113144

SUMMARY

Technical Problem

Hitherto, a shape of a press formed part immediately after a release from a press-forming die and springback has been predicted by a press forming simulation in which the above-described press forming analysis in the first stage and springback analysis in the second stage are integrated. However, when comparing a shape of a press formed part, which shape is predicted by the press forming simulation, with a shape of a press formed part that is actually press-formed, the inventors have found that there is a press formed part for which shape prediction accuracy by the press forming simulation is low.

Then, the press formed part for which the shape prediction accuracy becomes low in the press forming simulation and a cause thereof have been investigated, and it has been found that shapes are different immediately after the press forming (immediately after a release from a press-forming die and spring-back) and after several days in a press formed part having a bent portion in which a metal sheet is bent.

An example in which a shape change of a press formed part 21, which has a U-shape cross-sectional shape and is illustrated in FIG. 10, over time is measured is illustrated in FIG. 11. As illustrated in FIG. 11, when an opening amount of the press formed part 21 immediately after a release from a press-forming die and springback is set to a reference (0), it can be understood that a shape change in which an opening amount of side wall portions 25 gradually increases is generated over time thereafter.

Although such a shape change of the press formed part over time seems to be similar to a phenomenon in which a structural member that keeps receiving a high press load from the outside gradually deforms, such as a creep phenomenon (for example, Patent Literature 3), a phenomenon generated in the press formed part to which no press load is applied from the outside as described above has not been known until now.

Thus, it has been found that it is not possible to reduce a further shape change of a press formed part over time after the springback only by a method of using a press-forming die designed in consideration of a shape change due to the springback or a method of specifying a portion contributing to the springback and taking a measure to reduce the springback, and that it is necessary to control the shape change of the press formed part over time after the springback.

Furthermore, it has also been found that, in a case where the press formed part is fabricated with another part, a trouble is generated in a next step when the shape change is generated in the press formed part over time, and thus it is necessary to take some measures.

The present invention has been made to solve the above-described problems, and is to provide a press forming method in which a shape change generated in a press formed part over time after press forming is controlled or a measure is taken against a shape change over time of a press formed part fabricated with another part in a next step, and a shape evaluation method for the press formed part fabricated with another part in the next step.

Solution to Problem

A press forming method according to the present invention controls a shape change of a press formed part over time after the press formed part springs back at a moment of a release from a press-forming die, and includes: a press forming step of press forming a metal sheet into the press formed part by using the press-forming die; a die releasing step of releasing the press formed part, which is press-formed, from the press-forming die; and a post-release die holding step of holding the released press formed part in a forming bottom dead center shape for 30 minutes or more by using the press-forming die.

A press forming method according to the present invention controls a shape change of a press formed part over time after the press formed part springs back at a moment of a release from a press-forming die, and includes: a press forming step of press forming a metal sheet into the press formed part by using the press-forming de; a die releasing step of releasing the press formed part, which is press-formed, from the press-forming die; and a post-release jig holding step of holding a whole or part of the released press formed part in a previously-set predetermined shape for 30 minutes or more by using a jig that can perform holding in the predetermined shape, the jig including another press-forming die having the same shape as the press-forming die.

A press forming method according to the present invention controls a shape change of a press formed part over time after the press formed part springs back at a moment of a release from a press-forming die, and includes: a press forming step of press forming a metal sheet into the press formed part by using the press-forming die; a pre-release holding step of holding the press formed part, which is press-formed, at a forming bottom dead center for 30 minutes or more without the release from the press-forming die; and a die releasing step of releasing the press formed part from the press-forming die after the pre-release holding step.

A press forming method according to the present invention for a press formed part fabricated with another part after press forming includes: a press forming step of press forming a metal sheet into the press formed part by using a press-forming die; a die releasing step of releasing the press formed part, which is press-formed, from the press-forming die; and a shape changing step of changing a shape of the press formed part by leaving the released press formed part for 30 minutes or more after the die release before a use in fabrication.

A shape evaluation method according to the present invention for a press formed part in which method a shape of the press formed part fabricated with another part after press forming is evaluated includes: a press forming step of press forming a metal sheet into the press formed part by using a press-forming die; a die releasing step of releasing the press formed part, which is press-formed, from the press-forming die; a shape measuring step of measuring the shape of the press formed part after leaving the released press formed part for 30 minutes or more after the die release before a use in fabrication; and a shape determination step of determining that the press formed part is to be used in the fabrication when the measured shape of the press formed part is within a previously-set predetermined range.

Advantageous Effects of Invention

In the present invention, a metal sheet is press-formed into a press formed part with a press-forming die, and the press formed part that is press-formed is held, after being released from the press-forming die, in a forming bottom dead center shape with the press-forming die or in a previously-set predetermined shape with a jig, which is capable of holding a whole or part of the press formed part in the predetermined shape, for 30 minutes or longer, for example. Thus, a residual stress in the press formed part can be relaxed and reduced, and a shape change of the press formed part over time after the release from the press-forming die and spring-back can be controlled.

Furthermore, in the present invention, the press formed part released from the press-forming die is left for 30 minutes or more and a shape of the press formed part is changed before fabrication with another part in a next step, or the shape of the press formed part is measured after the press formed part is left for 30 minutes or more before being used in the next step. When the measured shape of the press formed part is within a previously-set predetermined range, it is determined that the press formed part is to be used in the next step. Thus, it is possible to avoid a trouble in the next step due to the shape change of the press formed part over time.

DESCRIPTION OF EMBODIMENTS

Figure 2:
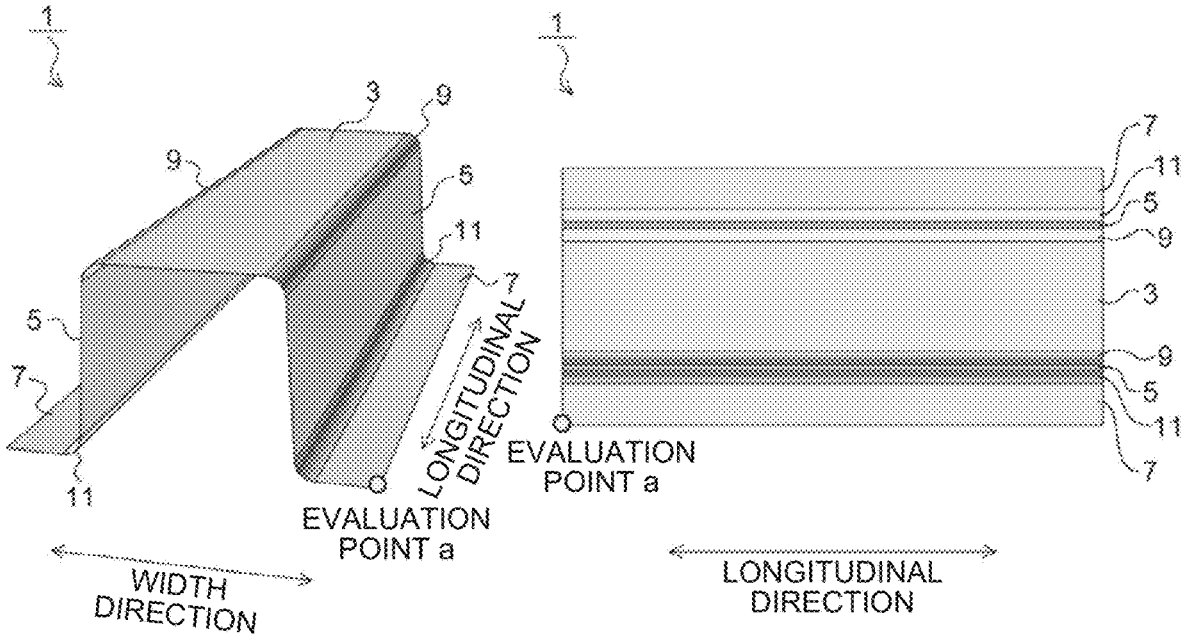
FIG. 2 is a view illustrating a press formed part that has a hat-shaped cross-sectional shape and that is an example of a forming object and a press formed part in the present invention.

In order to solve the above-described problems and to establish a method of controlling a shape change or a press formed part from immediately after the press formed part is released from a press-forming die and springs back, various studies have conducted on a cause of a shape change over time with a press formed part 1 having a hat-shaped cross-sectional shape in a manner illustrated in FIG. 2 being an example.

Figure 12:
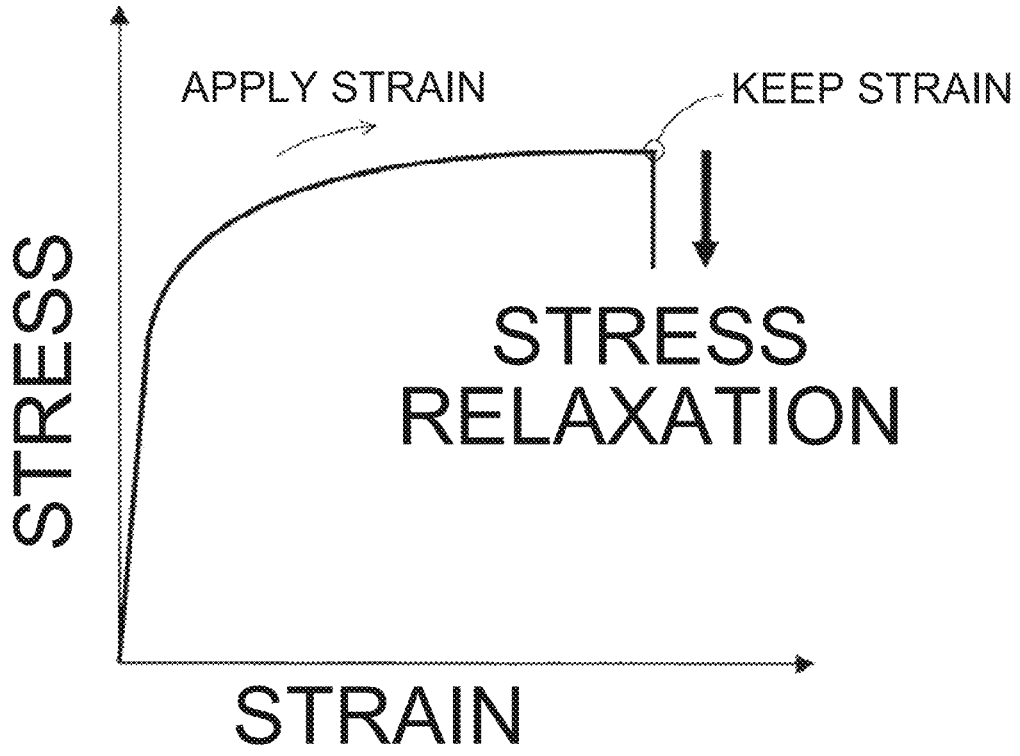
FIG. 12 is a view for describing a stress relaxation phenomenon in which stress is reduced over time in a state in which strain is kept constant.

As a result, the inventors have focused on a stress relaxation phenomenon in which stress is gradually relaxed and reduced over time while strain is kept constant in a stress-strain diagram in a manner illustrated in FIG. 12, and have found that a shape balanced with a moment of force of the press formed part 1 changes as residual stresses in a punch shoulder 9, a die shoulder 11, a side wall portion 5, and the like bent by press forming are gradually relaxed over time without being forced from the outside also in the press formed part 1 after the springback.

As an example, the shape change due to the relaxation of the residual stresses in the punch shoulder 9 and the die shoulder 11 of the press formed part 1 will be described with reference to the schematic diagram illustrated in FIG. 13. Note that although an example of a cross-sectional shape and the residual stress of the punch shoulder 9 is illustrated in FIG. 13, similar relaxation of the residual stress and shape change are also generated in the die shoulder 11.

Figure 13:
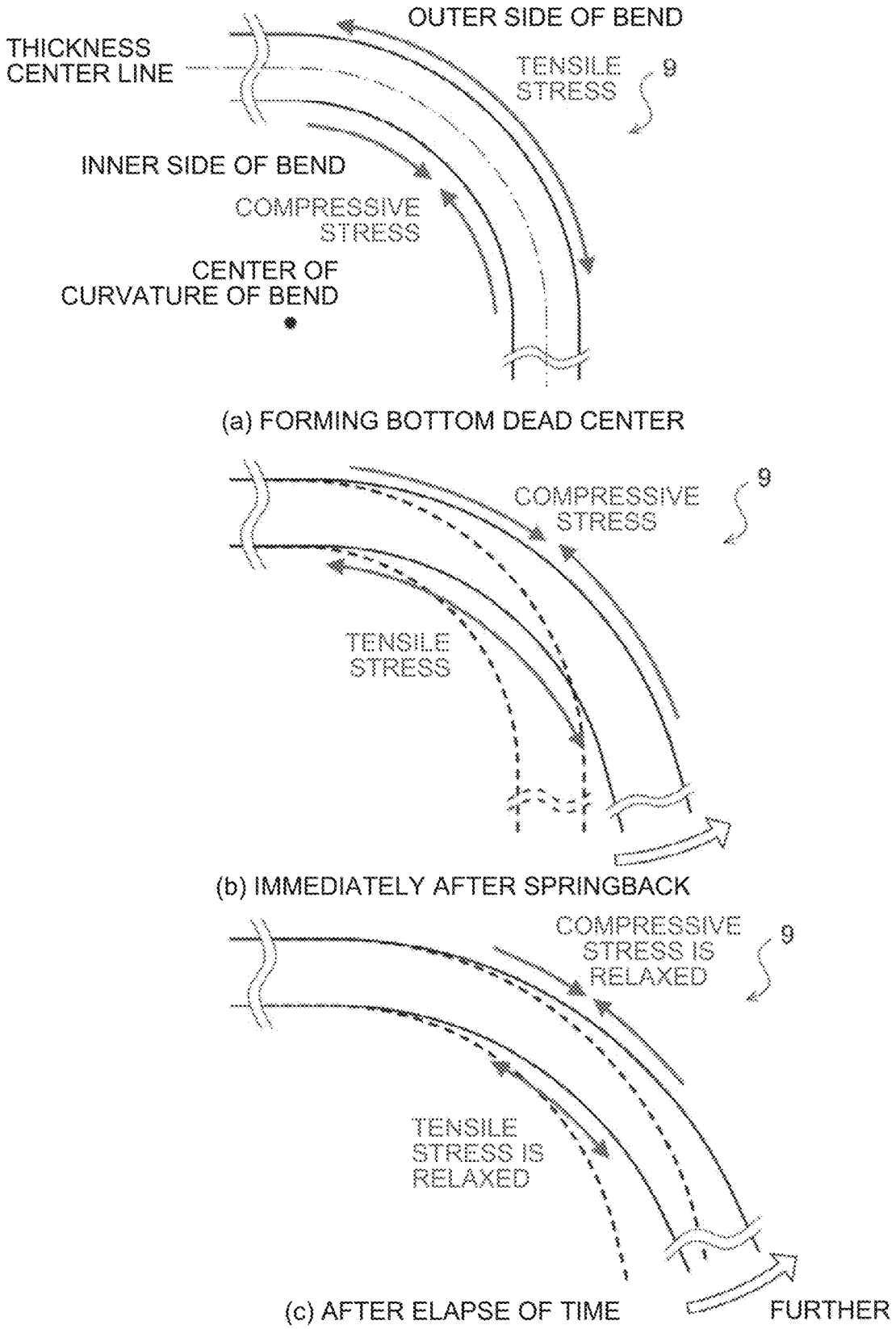
FIG. 13 is a view for describing a shape change due to stress relaxation in a punch shoulder of the press formed part having the hat-shaped cross-sectional shape ((a) forming bottom dead center, (b) immediately after springback, and (c) after elapse of time).

First, at the time of press forming, when a blank (such as metal sheet) is press-formed up to a forming bottom dead center with a press-forming die including a punch and a die, a tensile stress is generated on an outer side of a bend of the punch shoulder 9 and a compressive stress is generated on an inner side of the bend as illustrated in FIG. 13(*a*). Note that while the outer side of the bend is a side opposite to a center of a curvature of the bend with respect to a center line of a thickness in a cross section of the bent portion, the inner side of the bend is the same side as the center of the curvature of the bend (same applies hereinafter).

Then, when the press formed part 1 is removed (released) from the press-forming die, springback of the press formed part 1 is instantaneously generated with the residual stress generated during the press forming as a driving force. At that time, as illustrated in FIG. 13(*b*), a change in a bend angle of the punch shoulder 9 in a manner of returning to a shape of a flat blank before the press forming is generated, and a shape at the forming bottom dead center (broken line in FIG. 13(*b*)) is deformed to a shape in which the bent angle of the punch shoulder 9 is increased (solid line in FIG. 13(*b*)). However, since the punch shoulder 9 has rigidity, force to return to the shape before the press forming is hindered, whereby the compressive stress is generated on the outer side of the bend and the tensile stress is generated on the inner side of the bend as illustrated in FIG. 13(*b*).

Then, as illustrated in FIG. 13(*c*), the force to return to the shape before the press forming is gradually weakened over time, and a change in the bent angle in which change the bend is further increased is generated in the punch shoulder 9 in such a manner that the shape is balanced with the moment of force in the press formed part 1 (solid line in FIG. 13(*c*))

That is, when the press formed part springs back from the forming bottom dead center after the press forming, a residual stress is generated therein at the time point. With respect to the generated residual stress, for a difference between a residual stress on a front side and a residual stress on a back side in a thickness direction, the difference between the residual stress on the front side and the residual stress on the back side in the thickness direction of the press formed part is relaxed and reduced with the lapse of time units. As a result, it has been found that a processed portion of the press formed part has a shape in which the residual stress is reduced from that of the shape immediately after the springback.

This phenomenon is quite different from a behavior of the conventional springback due to the residual stress reduction. In the behavior of the conventional springback, with respect to the residual stress generated at the forming bottom dead center after the press forming, when a value of the residual stress to be generated is forcibly reduced or a difference between the residual stresses to be generated on the front side and the back side of the press formed part is forcibly reduced by a specific means, the springback is controlled and the shape at the press forming bottom dead center is kept in the state after the press forming.

On the other hand, in a behavior of the stress relaxation that is the object of the present invention, since an already-existing residual stress is relaxed without being forced by the outside after the springback from the forming bottom dead center after the press forming is generated, there is an attempt to return to a state with no residual stress. As a result, for example, the bent angle and a curl become larger than those immediately after the springback, and the shape of the press formed part becomes further away from a target shape.

Then, in such a press formed part 1 having a hat-shaped cross-sectional shape, even when a measure against the springback generated at a moment of a die release is sufficiently taken, a change in the bent angle is generated due to the stress relaxation over time in both the punch shoulder 9 and the die shoulder 11, as illustrated in FIG. 13. Thus, in a flange portion 7 of the press formed part 1, a deviation from a shape at the forming bottom dead center is generated.

As a result, when the shape change of the press formed part over time is generated before the press formed part that is press-formed and springs back is fabricated with another part in a next step, there is a case where a problem is generated in the next step.

As a result of studying a measure against such problems, the inventors have found the following. That is, by leaving a press formed part for a predetermined time before a use in a next step, a residual stress of the press formed part is relaxed and the press formed part is brought into a state in which a shape change is hardly generated, and by measuring a shape of the press formed part in the state in which the shape change is not generated and determining that the press formed part is to be used in the next step when the measured shape is within a predetermined range, it is possible to avoid a trouble tn the next step due to the shape change of the press formed part over time.

Hereinafter, a press forming method and a shape evaluation method for a press formed part according to the present invention will be described in the first embodiment to fourth embodiment. Note that in each of the first embodiment to the fourth embodiment, a press formed part 1 that has a hat-shaped cross-sectional shape including a top portion 3, side wall portions 5, and flange portions 7 and that includes, as bend ridges, punch shoulders 9 that respectively connect the top portion 3 and the side wall portions 5, and die shoulders 11 that respectively connect the side wall portions 5 and the flange portions 7 in a manner illustrated in FIG. 2 being an example.

First Embodiment

Figure 1:
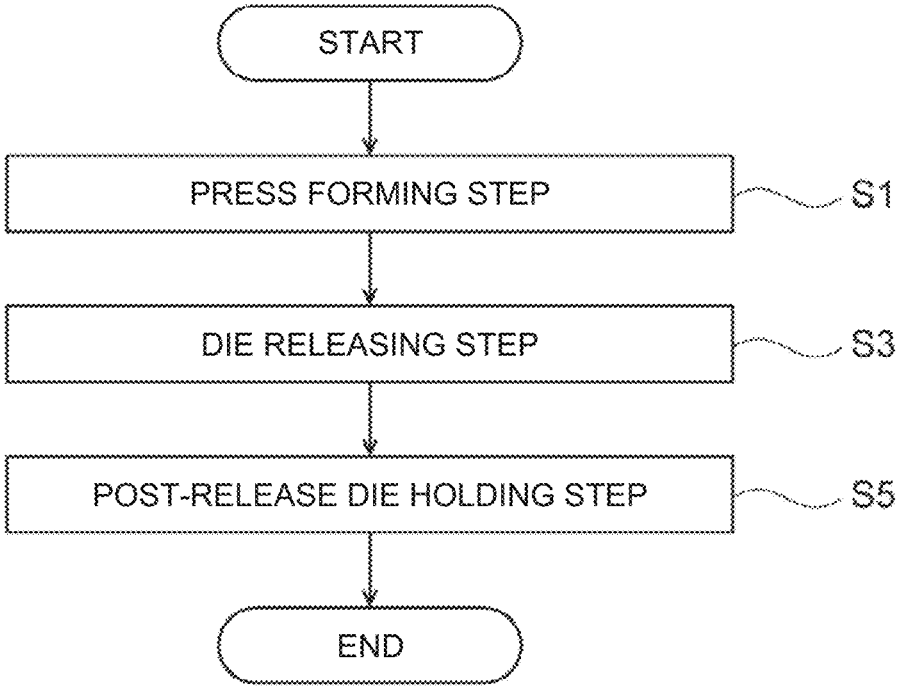
FIG. 1 is a flowchart illustrating a flow of processing in a press forming method according to a first embodiment of the present invention.

A press forming method according to the first embodiment of the present invention is to control a shape change of a press formed part 1 over time after springback at a moment of a release from a press-forming die. As illustrated in FIG. 1, a press forming step S1, a die releasing step S3, and a post-release die holding step S5 are included.

The press forming step S1 is a step or press forming a metal sheet into the press formed part 1 with a press-forming die. The press-forming die used in the press forming step S1 is not specifically limited as long as, for example, a die and a punch are included and the die can be relatively moved to a side of the punch up to a forming bottom dead center and press forming into the press formed part 1 can be performed.

The die releasing step S3 is a step of releasing the press formed part 1 press-formed in the press forming step S1 from the press-forming die.

The post-release die holding step S5 is a step of holding the press formed part 1, which is once released in the die releasing step S3, in a forming bottom dead center shape for 30 minutes or more by using again the press-forming die used for the press forming in the press forming step S1. Here, the forming bottom dead center shape means a shape of the press formed part 1 at the forming bottom dead center of the press-forming die used in the press forming step S1 (the same applies hereinafter.).

Note that the reason why the time for holding the press formed part 1 by using the press-forming die is set to 30 minutes or more is that residual stress is sufficiently relaxed and reduced when holding is performed for 30 minutes or more, and the shape change due to the stress relaxation after the held press formed part 1 is released from the press-forming die again can be sufficiently controlled.

The reason why the shape change of the press formed part 1 over time after the press formed part 1 is released from the press-forming die and springs back can be controlled by the press forming method according to the present first embodiment will be described with reference to FIG. 3. Note that although a cross-sectional shape and a residual stress of a punch shoulder 9 of the press formed part 1 are illustrated in FIG. 3, a similar residual stress and shape change are also generated in a die shoulder 11 of the press formed part 1.

First, when the press formed part 1 is press-formed and released from the press-forming die, springback is generated with the residual stress (tensile stress on an outer side of a bend of the punch shoulder 9 and compressive stress on an inner side of the bend) generated during the press forming being a driving force. At that time, as illustrated in FIG. 3(*a*), an angle of the punch shoulder 9 changes from a shape before the forming bottom dead center (broken line in FIG. 3(*a*)) to a shape in which a bent angle or the punch shoulder 9 is increased (solid line in FIG. 3(*a*)) in such a manner as to return to a state of a flat metal sheet before the press forming. However, since the punch shoulder 9 where the metal sheet is bent has rigidity, force to return to the shape before the press forming is hindered. Thus, as illustrated in FIG. 3(*a*), the compressive stress is generated on the outer side of the bend and the tensile stress is generated on the inner side of the bend in the punch shoulder 9.

Figure 3:
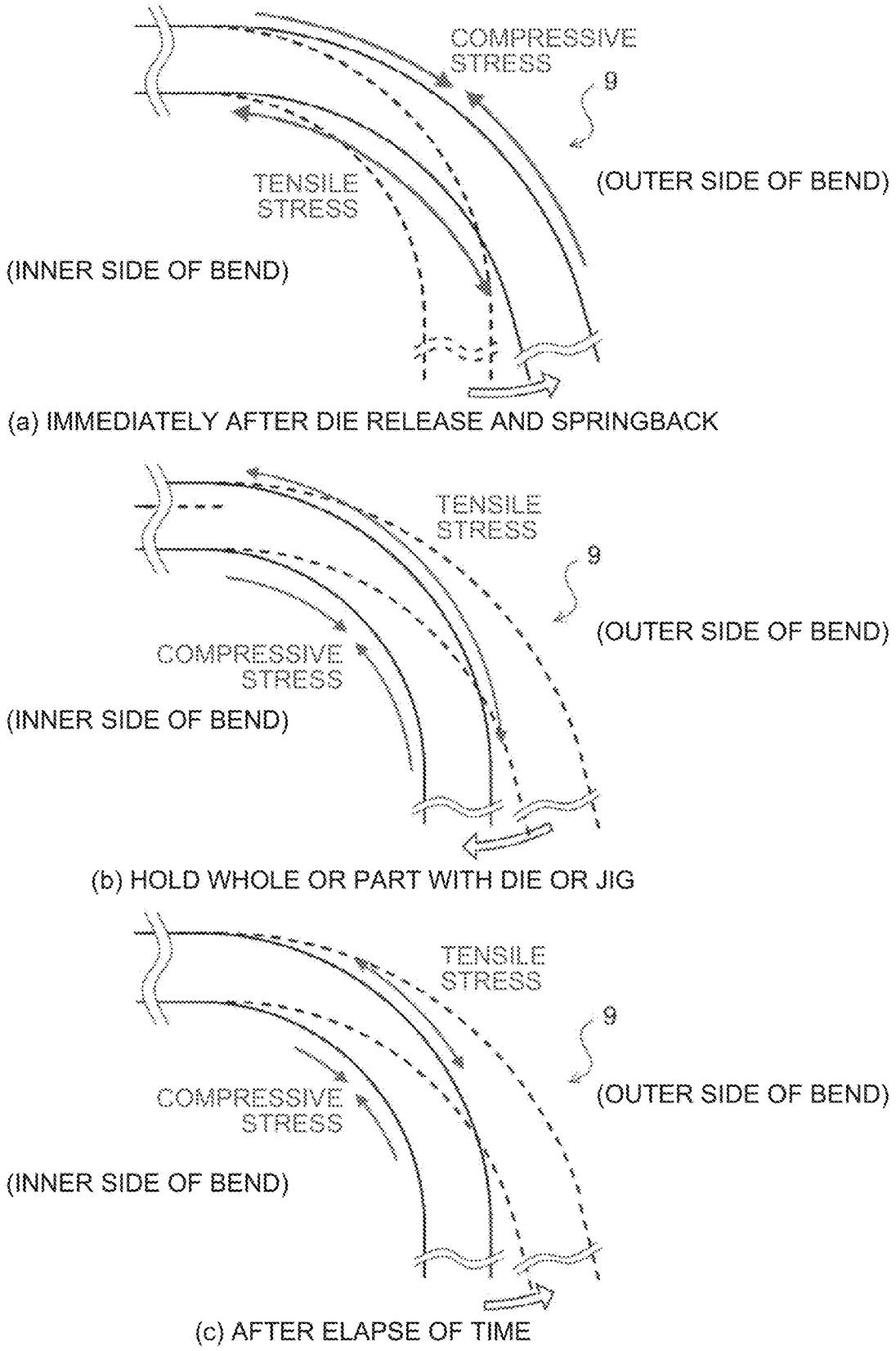
FIG. 3 is a view for describing a reason why a shape change over time can be controlled in the press forming method according to the first embodiment of the present invention.

Subsequently, when the sprung-back press formed part 1 is held by utilization of the press-forming die used for the press forming, the shape immediately after the springback (broken line in FIG. 3(*b*)) is deformed into the forming bottom dead center shape (solid line in FIG. 3(*b*)), and the tensile stress is generated on the outer side of the bend and the compressive stress is generated on the inner side of the bend in the punch shoulder 9, as illustrated in FIG. 3(*b*).

Then, when the press formed part is held in the forming bottom dead center shape for 30 minutes or more by utilization of the press-forming die, in the punch shoulder 9, the residual stress thereof gradually relaxed (reduced) while the punch shoulder 9 is kept in the forming bottom dead center shape (solid line in FIG. 3(*c*)), as illustrated in FIG. 3(*c*). As a result, since the residual stress is relaxed and reduced as compared with that of immediately after the holding by the press-forming die or jig (forming bottom dead center in the present embodiment), the shape change over time after the release from the press-forming die is performed again and springback is generated is significantly reduced.

Figure 4:
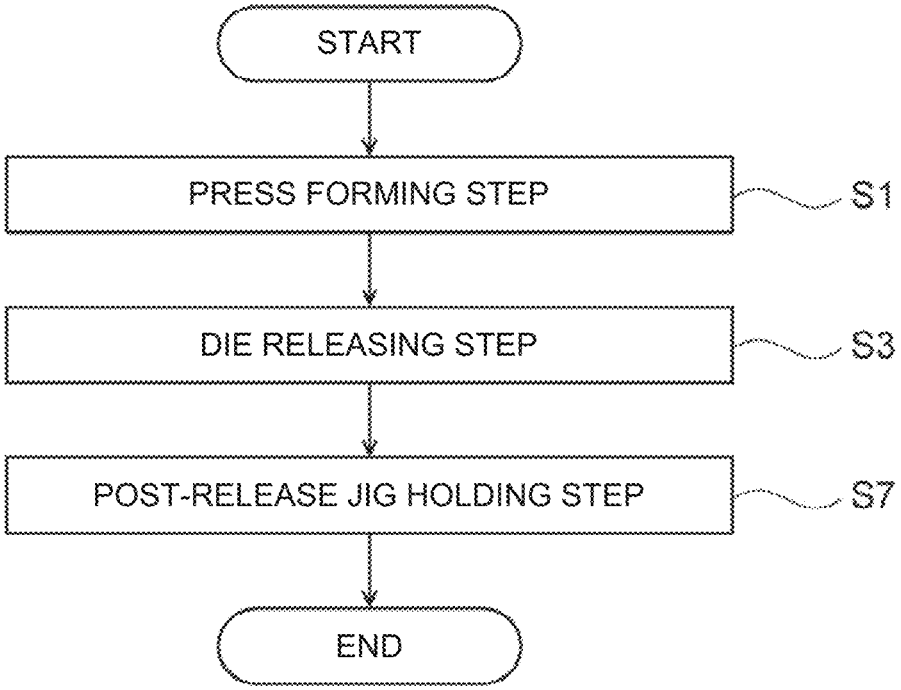
FIG. 4 is a flowchart illustrating a flow of processing in the press forming method according to another aspect of the first embodiment of the present invention.

Note that in the above description, in the post-release die holding step S5, the entire press formed part 1 is held in the forming bottom dead center shape by the press-forming die used for the press forming of the press formed part 1. However, a press forming method according to another aspect of the present first embodiment may include a post-release jig holding step S7 as illustrated in FIG. 4 instead of the post-release die holding step S5.

The post-release jig holding step S7 is a step of holding a whole or part of the press formed part 1 in a previously-set predetermined shape for 30 minutes or more by using a jig capable of holding the whole or part of the press formed part 1 in the predetermined shape.

Here, the previously-set predetermined shape may be, for example, a bottom dead center shape or a target shape (shape defined as a product) of the press formed part 1, or an intermediate shape between the bottom dead center shape and the target shape. In addition, holding a part of the press formed part 1 in the predetermined shape by using the jig may mean holding the entire press formed part 1 in the predetermined shape, or performing holding by using a jig that can hold only a part of the press formed part 1, such as the punch shoulder 9 in the predetermined shape. Furthermore, the reason why the time for holding the press formed part 1 by using the jig is set to 30 minutes or more is similar to the case where the holding is performed by utilization of the press-forming die described above.

As described above, after the press formed part 1 is released from the press-forming die and springs back, the whole or part of the press formed part is held in the previously-set predetermined shape in the post-release jig holding step S7, whereby a residual stress at the portion of the press formed part 1 which portion is held with the jig can be relaxed and reduced, the residual stress at the held portion of the press formed part 1 after the removal from the jig can also be reduced, and the shape change of the press formed part 1 over time can be reduced.

Note that in a case where the entire press formed part 1 is held in the post-release jig holding step S7, another press-forming die having the same shape as the press-forming die may be used, and the part of the press formed part 1 which part is held with the jig may be, for example, the punch shoulder 9 or the die shoulder 11 that are the bend ridges of the press formed part 1. However, the portion of the press formed part 1 which portion is held with the jig is not limited to the bend ridges such as the punch shoulder 9 and the die shoulder 11, and may be a portion having a large influence on the shape change due to stress relaxation over time, such as a side wall portion 5 that is bent and unbent.

Second Embodiment

Figure 5:
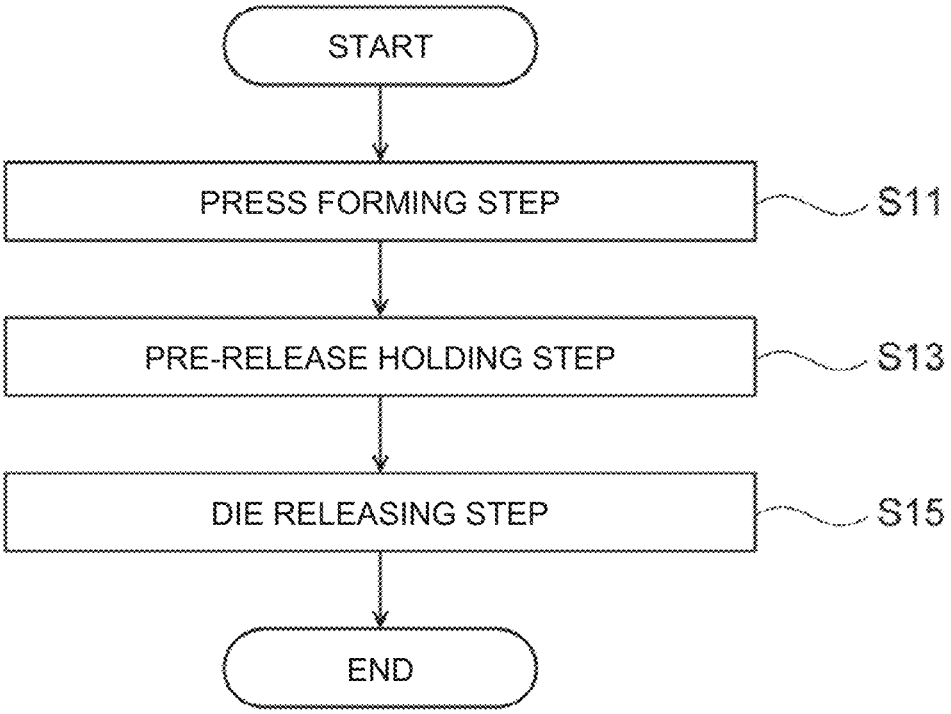
FIG. 5 is a flowchart illustrating a flow of processing in a press forming method according to a second embodiment of the present invention.

A press forming method according to the second embodiment of the present invention is to control a shape change of a press formed part 1 (FIG. 2) over time after springback at a moment of a release from a press-forming die. As illustrated in FIG. 5, a press forming step S11, a pre-release holding step S13, and a die releasing step S15 are included. Note that since the press forming step S11 is similar to the press forming step S1 of the first embodiment described above, the pre-release holding step S13 and the die releasing step S15 will be described below.

The pre-release holding step S13 is a step of holding the press formed part 1 at a forming bottom dead center for 30 minutes or more without performing releasing from the press-forming ore after performing the press forming thereof with the press-forming die in the press forming step S11.

The die releasing step S15 is a step of releasing the press formed part 1 held in the pre-release holding step S13 from the press-forming die.

The reason why the shape change of the press formed part 1 over time after the release from the press-forming die and the springback can be controlled by the press forming method according to the second embodiment will be described with reference to FIG. 6. Note that although a cross-sectional shape and a residual stress of a punch shoulder 9 of the press formed part 1 are illustrated in FIG. 6 as an example, similar reduction of a residual stress and shape change are generated also in a die shoulder 11 of the press formed part 1.

Figure 6:
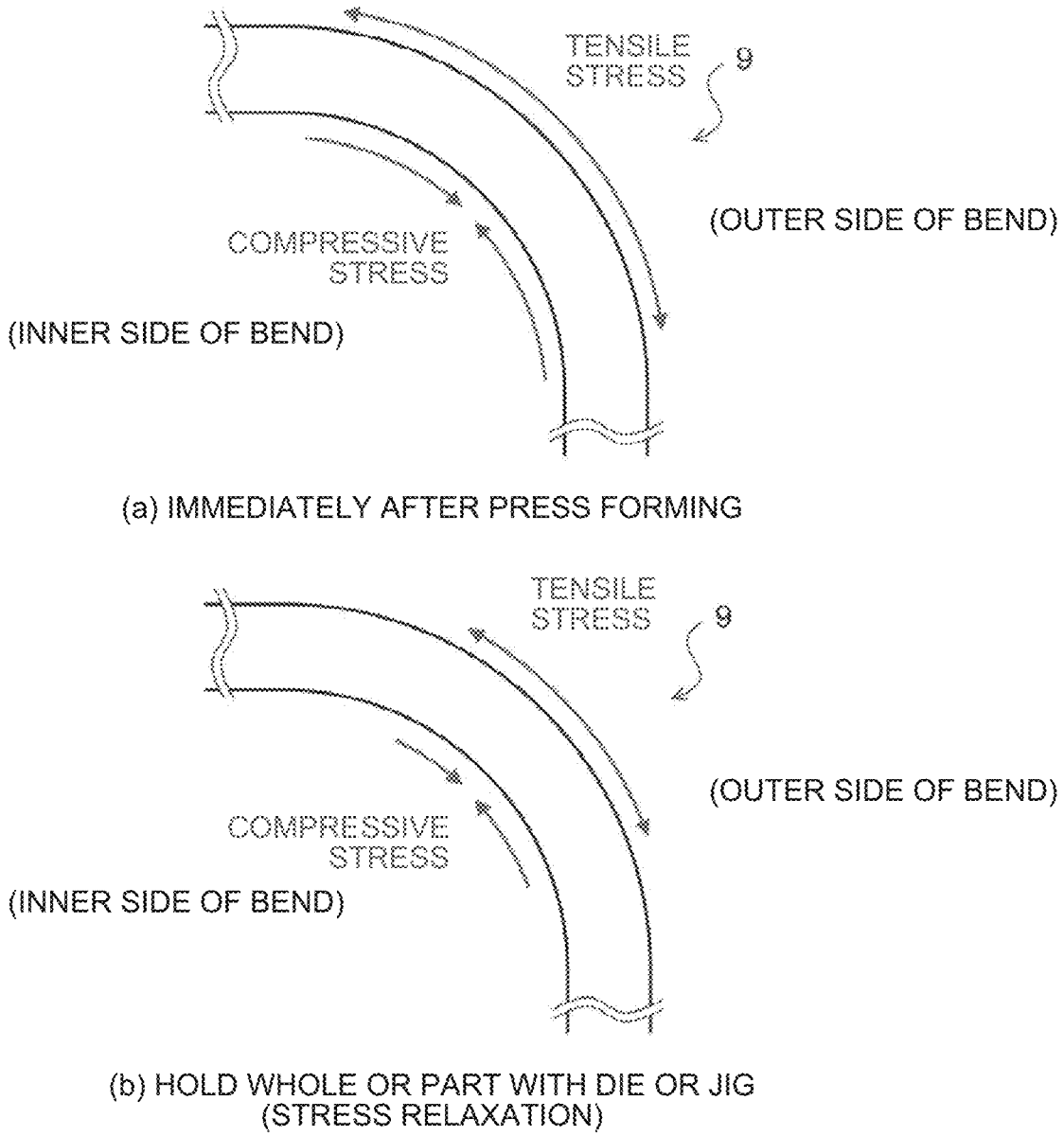
FIG. 6 is a view for describing a reason why a shape change over time can be controlled in the press forming method according to the second embodiment of the present invention.

First, when the press formed part 1 is press-formed with the press-forming die, a tensile stress is generated on an outer side of a bend and a compressive stress is generated on an inner side of the bend in the punch shoulder 9 as illustrated in FIG. 6(*a*).

Then, when the press formed part 1 is held at the forming bottom dead center for 30 minutes or more without being released from the press-forming die, the residual stress is gradually relaxed (reduced) at the punch shoulder 9 as illustrated in FIG. 6(*b*), and the residual stress becomes smaller than that of the punch shoulder 9 at the forming bottom dead center. Thus, in the press formed part 1 released after being held in the press-forming die for 30 minutes or more, the shape change due to stress relaxation over time after the release from the press-forming die and the springback is significantly smaller than that of the press formed part 1 released without being held in the press-forming die.

In such a manner, the shape change of the press formed part 1 over time after the release from the press-forming die and the springback can be controlled by the press forming method according to the second embodiment.

Third Embodiment

Figure 7:
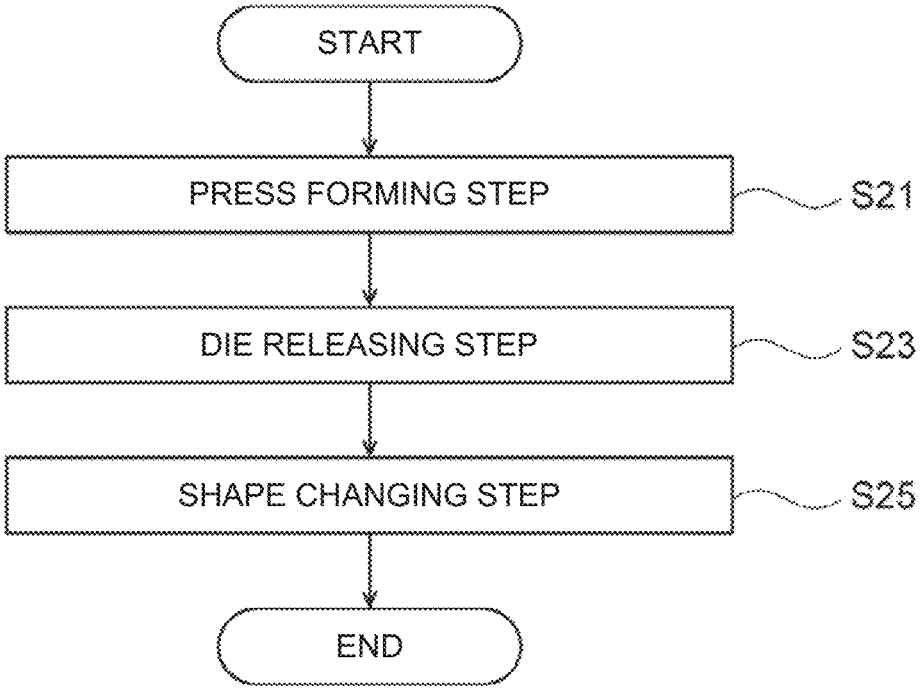
FIG. 7 is a flowchart illustrating a flow of processing in a press forming method according to a third embodiment of the present invention.

A press forming method according to the third embodiment of the present invention is to perform press forming of a press formed part 1 fabricated with another part after the press forming, and includes a press forming step S21, a die releasing step S23, and a shape changing step S25 as illustrated in FIG. 7.

Note that since the press forming step S21 and the die releasing step S23 are similar to the press forming step S1 and the die releasing step S3 of the first embodiment of the present invention described above, a description thereof is omitted herein and the shape changing step S25 will be described below.

The shape changing step S25 is a step of changing the shape of the press formed part 1 by leaving the press formed part 1, which is released in the die releasing step S23, for 30 minutes or more after the die release before a use in fabrication.

Figure 11:
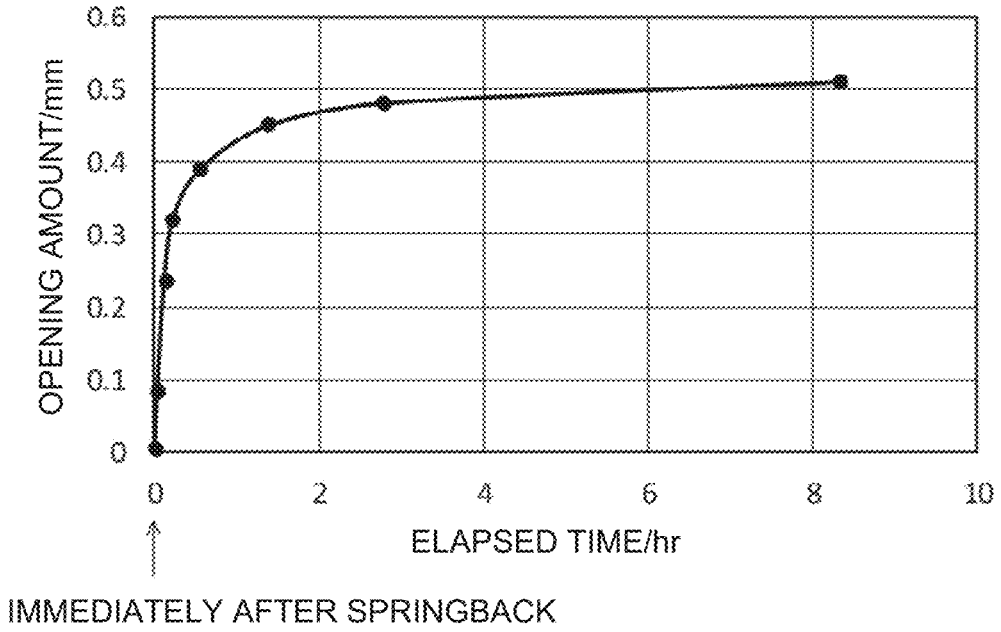
FIG. 11 is a view illustrating, as an example of the shape change of the press formed part over time, a measurement result of an opening amount immediately after the press formed part having the U-shape cross-sectional shape is released from a press-forming die and springs back.

Note that the reason why the time for leaving the press formed part 1 and causing the shape change is set to 30 minutes or more is that a residual stress in the press formed part 1 is sufficiently relaxed and reduced and a further shape change after springback becomes small when 30 minutes or more elapses after the die release (see FIG. 11).

According to the press forming method of the present third embodiment, the press formed part, which is press-formed, is left before being fabricated, whereby the press formed part 1 is fabricated with another part in a next step after the shape change of the press formed part 1 due to the stress relaxation over time is generated. Thus, a trouble due to a shape change generated before the use in the next step after the press forming is prevented from being generated in the next step.

Fourth Embodiment

Figure 8:
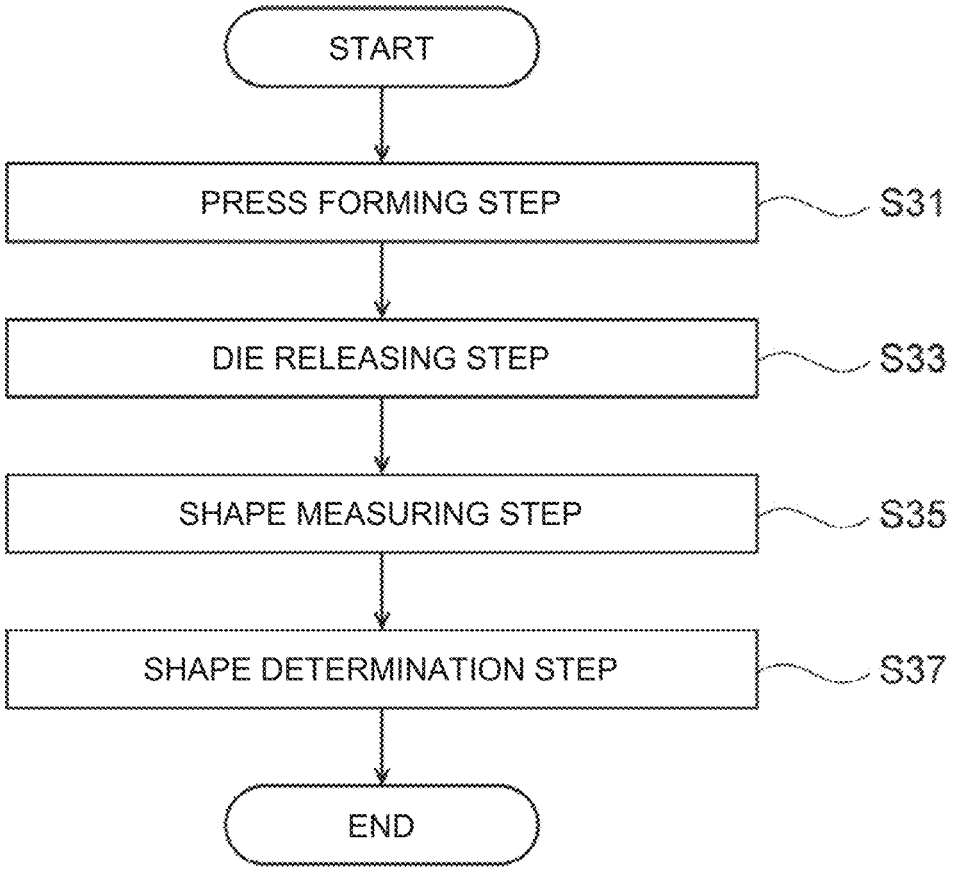
FIG. 8 is a flowchart illustrating a flow of processing in a shape evaluation method for a press formed part according to a fourth embodiment of the present invention.

A shape evaluation method for a press formed part according to the fourth embodiment of the present invention is to evaluate a shape of a press formed part 1 fabricated with another part after press forming, and includes a press forming step S31, a die releasing step S33, a shape measuring step S35, and a shape determination step S37 as illustrated in FIG. 8. Note that since the press forming step S31 and the die releasing step S33 are similar to the press forming step S1 and the die releasing step S3 of the first embodiment described above, the shape measuring step S35 and the shape determination step S37 will be described.

The shape measuring step S35 is a step of measuring a shape of the press formed part 1 after the press formed part 1 released from a press-forming die is left for 30 minutes or more after the die release and before a use in fabrication.

Here, the reason why the shape is measured after the press formed part 1 is released from the press-forming die and left is that a residual stress in the press formed part 1 released from the press-forming die is sufficiently relaxed and reduced to cause a shape change due to stress relaxation. Furthermore, the reason why the time for leaving is set to 30 minutes or more is that the residual stress in the press formed part 1 is sufficiently relaxed and reduced and a further shape change after springback becomes small when 30 minutes or more elapses after the die release (see FIG. 11).

The shape determination step S37 is a step of determining that the press formed part 1 is to be used for fabrication when the shape of the press formed part 1 which shape is measured in the shape measuring step S35 is within a previously-set predetermined range.

As described above, according to the shape evaluation method for a press formed part of the present fourth embodiment, the press formed part 1, which is press-formed, is released from the press-forming die and left for 30 minutes or more, the shape thereof is measured after the shape change due to stress relaxation over time is sufficiently generated, and it is, determined that the press formed part 1 is to be used in the next step when the measured shape thereof is within the previously-set predetermined range. Thus, a trouble due to a shape change generated in the press formed part 1 before the fabrication after the press forming can be prevented from being generated in the next step.

Note that the previously-set predetermined range in the shape determination step S37 may be appropriately set within a range in which no trouble is generated in fabrication with another part.

The above-described press forming method and shape evaluation method for a press formed part according to the present invention do not specifically limit a shape, a kind, and the like of a metal sheet used as a blank for the press forming of the press formed part, and the press formed part, and are more effective for an automotive part press formed by utilization of a metal sheet with which the press formed part has a higher residual stress.

Specifically, the blank is preferably a metal sheet having tensile strength of a 150 MPa grade or higher and a 2000 MPa grade or lower and a thickness of 0.5 mm or more and 4.0 mm or less.

Since a blank (metal sheet) having tensile strength lower than the 150 MPa grade is hardly, used for the press formed part, there is little advantage of applying the present invention. With respect to a part in which a blank having tensile strength of the 150 MPa grade or higher is used and which has low rigidity, such as an outer panel of an automobile, a shape change due to a change in residual stress is likely to be generated. Thus, there are many advantages of applying the present invention and the present invention can be suitably applied.

On the other hand, since a blank having tensile strength exceeding the 2000 MPa grade has poor elongation, for example, there is a case where a crack is generated in the punch shoulders 9 and the die shoulders 11 in the press forming process of the press formed part 1 having the hat-shaped cross-sectional shape in a manner illustrated in FIG. 2 and the press forming cannot be performed.

In addition, with respect to a shape of a press formed part, the present invention is not limited to the press formed part 1 having the hat-shaped cross-sectional shape in a manner illustrated in FIG. 2. For example, it is desirable to apply the present invention to a press formed part having a shape with a portion where residual stress becomes high, such as a press formed part having a Z-shape cross-sectional shape, a U-shape cross-sectional shape, or an L-shape cross-sectional shape.

Thus, as the kind of the press formed part, it is preferable to apply the present invention to automotive parts such as outer panels such as a door, roof, and hood having low rigidity, and frame parts such as an A pillar, B pillar, roof rail, side rail, front side member, rear side member, and cross member using a high-strength metal sheet.

Note that the present invention can be applied to a press formed part press-formed by crash forming, bend forming, or deep drawing, and a press method of the press formed part is not limited.

EXAMPLE

An experiment for confirming an action and effect of the press forming method according to the present invention was conducted, and results thereof will be described below.

In the experiment, first, press forming of the press formed part 1 having the hat-shaped cross-sectional shape illustrated in FIG. 2 was performed by bend forming by utilization of a metal sheet. A having the mechanical properties illustrated in Table 1 in the following. In a forming bottom dead center shape of the press formed part 1, a radius of curvature and a bent angle of the punch shoulders 9 were respectively set to 5 mm and 95°, and a radius of curvature and a bent angle of the die shoulders 11 were respectively set to 5 mm and 95°. Note that a thickness of the metal sheet A is 1.6 mm, yield strength is 880 MPa, tensile strength is 1210 MPa, and elongation is 13%.

TABLE 1

| | Thickness/mm | Yield strength/MPa | Tensile strength/MPa | Elongation/% |
|---|---|---|---|---|
| Metal sheet A | 1.6 | 880 | 1210 | 13 |

Figure 9:
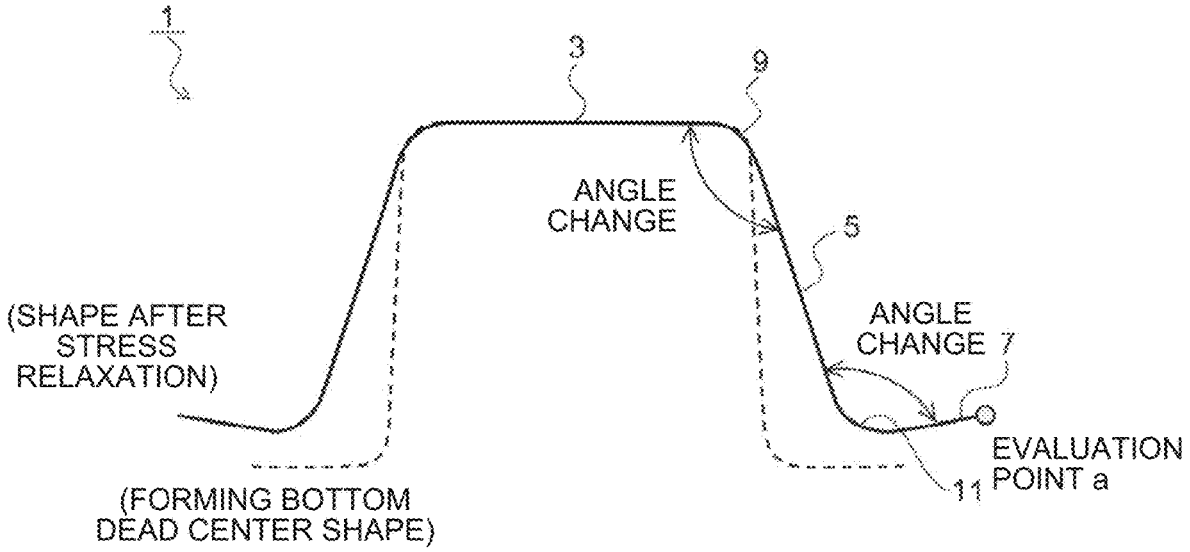
FIG. 9 is a view illustrating, in an example, a cross-sectional shape of a press formed part that has a hat-shaped cross-sectional shape and that is a forming object, and a position of an evaluation point for evaluation of a deviation amount from a forming bottom dead center shape.
Figure 10:
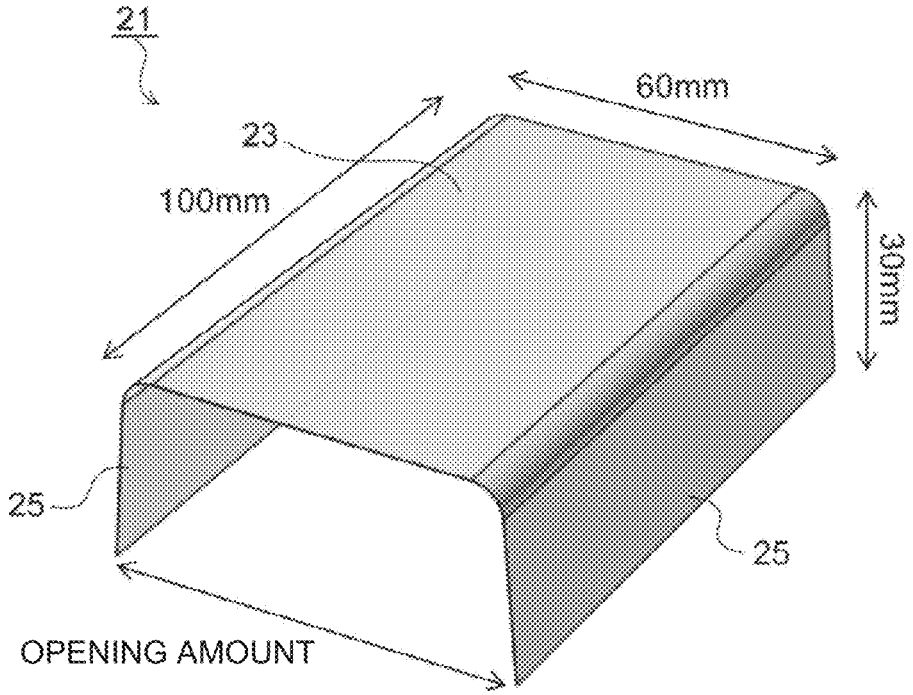
FIG. 10 is a view illustrating a press formed part that has a U-shape cross-sectional shape and that is a measurement object of a shape change over time.

Then, the press formed part 1 that was press-formed up to a forming bottom dead center was released from a press-forming die, and a shape change over time of the press formed part 1 after springback was measured (conventional example). As a result, as illustrated in FIG. 9, angle changes were generated at the punch shoulders 9 and the die shoulders 11, and a deviation from the forming bottom dead center shape of the press formed part 1 was performed. Note that a center of the top portion 3 of the press formed part 1 in a longitudinal direction was made to match and a distance in a cross section in a width direction parallel to the top portion 3 was used as a deviation amount described in the following.

In the press formed part 1, a portion most deviated from the forming bottom dead center shape was an edge portion of the press formed part 1 illustrated in FIG. 2 (leading end of a flange portion in the longitudinal direction, and referred to as an "evaluation point a" in the following). Thus, when the deviation amount at the evaluation point a from the forming bottom dead center shape was measured, the deviation amount was increased over time with the deviation amount being 14.3 mm immediately after the press forming (immediately after the die release and springback) and being 16.0 mm after the lapse of two days.

Next, as an invention example, a shape change of the press formed part 1 over time after holding in the press-forming die and release from the press forming die was measured with respect to a case where the press formed part 1, which was released from the press-forming die and sprang back, was returned to the press-forming die and held in the forming bottom dead center shape for a predetermined time (first invention example and second invention example), and a case where the press formed part 1, which was press-formed up to the forming bottom dead center, was held as it was in the press-forming die for a predetermined time (third invention example and fourth invention example). Results of measuring the deviation amount of the evaluation point a from the forming bottom dead center shape immediately after the press forming of the press formed part 1 (immediately after the die release and springback), and after holding in the press-forming die for a predetermined time was performed and then the die release was performed are illustrated in Table 2.

TABLE 2

| | Deviation amount of evaluation point a/mm | | | Difference from deviation amount |
|---|---|---|---|---|
| Example | Immediately after press forming | After lapse of 30 minute | After lapse of two day | immediately after press forming |
| Conventional example | 14.3 | — | 16.0 | 1.7 |

TABLE 2-continued

| Example | Deviation amount of evaluation point a/mm | | | Difference from deviation amount |
|---|---|---|---|---|
| | Immediately after press forming | After lapse of 30 minute | After lapse of two day | immediately after press forming |
| First invention example | 14.3 | 14.6 *1 | 14.8 | 0.5 |
| Second invention example | 14.3 | — | 14.5 *2 | 0.2 |
| Third invention example | — (unmeasurable since being inside press-forming die) | 14.9 *1 | 15.3 | 1.0 * |
| Fourth invention example | — (unmeasurable since being inside press-forming die) | — | 14.4 *2 | 0.1 * |

*1 Once being removed from press-forming die to measure deviation amount, and returned to press-forming die again and held
*2 Being held in press-forming die until two day elapse
* Difference from deviation amount immediately after press forming in conventional example (=14.3 mm)

In the first invention example, the sprung-back press formed part was returned to the press-forming die and held for 30 minutes. The deviation amount of the evaluation point a was 14.6 mm immediately after the die release after the holding in the press-forming die, and was 14.8 mm after the press formed part was return to the press-forming die thereafter and two days elapsed from the die release. A difference between the deviation amount after the lapse of two days and the deviation amount immediately after the press forming (immediately after the die release and the springback) (=14.3 mm) was 0.5 mm, and was decreased compared to the difference from the deviation amount in the conventional example (=1.7 mm).

In the second invention example, the sprung-back press formed part was returned to the press-forming die and held for two days continuously. The deviation amount of the evaluation point a was 14.5 mm immediately after the die release after the holding in the press-forming die. Then, a difference between the deviation amount after the lapse of two days and the deviation amount immediately after the press forming (immediately after the die release and the springback) (=14.3 mm) was 0.2 mm, and was further decreased compared to the first invention example, and the shape change over time could be controlled.

In the third invention example, the press formed part was released from the press-forming die after being held in the press-forming die as it was for 30 minutes after the press forming. The deviation amount of the evaluation point a was 14.9 mm immediately after the die release after the holding, and was 15.3 mm after the press formed part was returned to the press-forming die again thereafter and two days elapsed from the die release. Then, in the third invention example, since the press formed part was held in the press-forming die as it was after the press forming, the shape thereof immediately after press forming could not be measured. However, a difference from the deviation amount immediately after the press forming (immediately after the die release and the springback) in the first conventional example was 1.0 mm, and was decreased compared to the difference from the deviation amount in the conventional example, and the shape change over time could be controlled.

In the fourth invention example, the time for holding the press formed part in the press-forming die after the press forming was increased to continuous two days as compared with the third invention example, and the deviation amount of the evaluation point a was 14.4 mm. Then, a difference from the deviation amount immediately after the press forming (immediately after the die release and the springback) in the first conventional example was 0.1 mm, and was further decreased compared to the third invention example, and the shape change over time could be sufficiently controlled.

INDUSTRIAL APPLICABILITY

According to the present invention, it is possible to provide a press forming method in which a shape change generated in a press formed part over time after press forming is controlled or a measure is taken against a shape change over time or a press formed part fabricated with another part in a next step, and a shape evaluation method for the press formed part fabricated with another part in the next step.

REFERENCE SIGNS LIST

1 PRESS FORMED PART
3 TOP PORTION
5 SIDE WALL PORTION
7 FLANGE PORTION
9 PUNCH SHOULDER
11 DIE SHOULDER
21 PRESS FORMED PART
23 TOP PORTION
25 SIDE WALL PORTION

The invention claimed is:

1. A press forming method for controlling a shape change of a press formed part over time after the press formed part springs back at a moment of a release from a press-forming die, the press forming method comprising:

a press forming step of press forming a metal sheet into the press formed part by using the press-forming die;

a die releasing step of releasing the press formed part, which is press-formed, from the press-forming die; and a post-release die holding step of holding the released press formed part in a forming bottom dead center shape for 30 minutes or more by using the press-forming die.

2. A press forming method for controlling a shape change of a press formed part over time after the press formed part springs back at a moment of a release from a press-forming die, the press forming method comprising:

a press forming step of press forming a metal sheet into the press formed part by using the press-forming die;

a die releasing step of releasing the press formed part, which is press-formed, from the press-forming die; and a post-release jig holding step of holding a whole or part of the released press formed part in a previously-set predetermined shape for 30 minutes or more by using a jig that can perform holding in the predetermined shape, the jig including another press-forming die having the same shape as the press-forming die.

* * * * *